US006250896B1

(12) United States Patent
Lehman

(10) Patent No.: US 6,250,896 B1
(45) Date of Patent: Jun. 26, 2001

(54) PUMP FOR A CRYOGENIC LIQUID AND PUMP UNIT AND DISTILLATION COLUMN WHICH ARE EQUIPPED WITH SUCH A PUMP

(75) Inventor: Jean Yves Lehman, Maisons Alfort (FR)

(73) Assignee: L'Air Liquide Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/376,004

(22) Filed: Aug. 19, 1999

(30) Foreign Application Priority Data

Aug. 19, 1998 (FR) ..... 98 10537

(51) Int. Cl.[7] ..... F04B 1/04
(52) U.S. Cl. ..... 417/373; 62/646; 62/50.6
(58) Field of Search ..... 417/373; 62/646, 62/653, 644, 50.6

(56) References Cited

U.S. PATENT DOCUMENTS

| | | | | |
|---|---|---|---|---|
| 3,176,620 | * | 4/1965 | Shiley | 103/87 |
| 3,652,186 | | 3/1972 | Carter | 417/370 |
| 4,303,428 | * | 12/1981 | Vandenbussche | 62/646 |
| 4,418,544 | * | 12/1983 | Heybutzki et al. | 62/50.6 |
| 4,781,739 | * | 11/1988 | Erickson | 62/651 |
| 4,915,602 | * | 4/1990 | Tschopp | 417/503 |
| 5,306,124 | | 4/1994 | Back | 417/406 |
| 5,404,725 | * | 4/1995 | Arriulou | 62/646 |
| 5,426,947 | * | 6/1995 | Grenier | 62/646 |
| 5,431,546 | | 7/1995 | Rhoades | 417/313 |
| 5,475,980 | * | 12/1995 | Grenier et al. | 62/646 |
| 5,529,464 | | 6/1996 | Emerson et al. | 417/405 |
| 5,545,015 | * | 8/1996 | Scherrer | 417/360 |
| 5,564,290 | * | 10/1996 | Bonaquist et al. | 62/646 |
| 5,649,425 | * | 7/1997 | Matsumura et al. | 60/648 |

FOREIGN PATENT DOCUMENTS

| | | |
|---|---|---|
| 1 487 490 | 9/1977 | (GB) . |
| 1 568 926 | 6/1980 | (GB) . |
| WO 84/04365 | 11/1984 | (WO) . |

* cited by examiner

*Primary Examiner*—Charles G. Freay
*Assistant Examiner*—Robert Z. Evora
(74) *Attorney, Agent, or Firm*—Young & Thompson

(57) ABSTRACT

A pump for a cryogenic liquid, in particular liquid oxygen, includes a hydraulic motor which is supplied with a motor liquid under pressure and drives a wheel for pumping the cryogenic liquid, and relative sealing device preventing contamination of the cryogenic liquid by the motor liquid.

19 Claims, 5 Drawing Sheets

PUMP FOR A CRYOGENIC LIQUID AND PUMP UNIT AND DISTILLATION COLUMN WHICH ARE EQUIPPED WITH SUCH A PUMP

BACKGROUND OF THE INVENTION

The invention relates to a pump for a cryogenic liquid, in particular a liquid obtained during an air distillation process, for example liquid oxygen.

DESCRIPTION OF THE RELATED ART

Pumps intended to pump cryogenic liquids, such as for example liquid oxygen, are known which have an electric motor and generally comprise two separate components, one of which is at ambient temperature and comprises an electric motor, and the other of which is at the temperature of the cryogenic liquid and comprises a pumping component driven by the electric motor.

U.S. Pat. No. 5,545,015 describes a cryogenic-liquid pump driven by a hydraulic motor.

In order to prevent the cryogenic liquid from warming up, expensive thermal insulation is arranged between the motor component and the pumping component in order to reduce the heat exchange between these two components.

Furthermore, the cryogenic liquids pumped in air-distillation plants often contain a large proportion of oxygen, which can pose serious problems in the event of short-circuit in the electrical equipment of the motor, causing dangerous metal fires.

SUMMARY OF THE INVENTION

The object of the invention is to overcome the various drawbacks by providing a pump which is more reliable and which can be manufactured at a relatively low cost price.

To that end, the invention relates to a pump for a cryogenic liquid, in particular liquid oxygen, comprising a hydraulic motor which is supplied with a motor liquid under pressure and drives a wheel for pumping the said cryogenic liquid, characterized in that it comprises relative sealing means preventing contamination of the cryogenic liquid by transfer of the motor liquid from the motor to the pumping wheel.

The pump according to the invention may also have one or more of the following characteristics:

- it is immersed in the cryogenic liquid to be pumped,
- the motor liquid under pressure is supercooled,
- the motor liquid has a density in excess of 400 kg/m$^3$,
- the hydraulic motor comprises a driving wheel which is driven by the said motor liquid and is mounted on a shaft common with the pumping wheel,
- the said common shaft is supported by bearings lubricated by means of the motor liquid,
- the said relative sealing means comprise a labyrinth seal arranged around the common shaft, between the driving wheel and the pumping wheel.
- the relative sealing means allow transfer of cryogenic liquid from the pumping wheel to the motor.

The cryogenic liquids to be pumped and the motor liquid may be selected so that the arrival of the cryogenic liquid in the motor does not cause vaporization either of the cryogenic liquid or of the motor liquid.

The invention furthermore relates to a unit for pumping a cryogenic liquid, characterized in that it comprises, arranged in a compartment which is thermally insulated and is filled with the cryogenic liquid to be pumped, two pumps as defined above which are immersed in the cryogenic liquid to be pumped and are arranged in parallel in a duct carrying the motor liquid under pressure.

The pumping unit according to the invention may furthermore have the characteristic according to which the pumping unit furthermore comprises, arranged in the duct carrying the motor liquid, means for switching between supply of the motor liquid to one or the other of the two pumps,

- the motor liquid is a cryogenic liquid. A cryogenic liquid is a liquid such as oxygen, nitrogen or argon.
- the motor liquid is miscible with the cryogenic liquid which is pumped.

The invention furthermore relates to a plant for distillation of a gas, in particular air, comprising at least a first and a second column, the pressure prevailing in the first column being higher than that prevailing in the second column, characterized in that it comprises a pump as defined above for pumping a cryogenic liquid delivered by one of the said columns, the said pump being driven by a motor liquid delivered by the plant.

The distillation plant according to the invention may furthermore have one or more of the following characteristics:

- the distillation plant comprises a double column, including in particular a medium-pressure column and a low-pressure column,
- the said cryogenic liquid which is pumped is an oxygen-rich liquid,
- the said cryogenic liquid which is pumped is a liquid which comes from an argon column,
- the said cryogenic liquid which is pumped is a liquid which comes from a low-pressure column and is intended to be sent to a vaporizer,
- the said columns are arranged side by side,
- the said motor liquid is liquid air delivered by a heat-exchange line,
- the said motor liquid is an oxygen-rich liquid,
- the said motor liquid is a low-oxygen liquid.

BRIEF DESCRIPTION OF THE DRAWINGS

Other characteristics and advantages of the invention will emerge from the following description, given by way of example without implying any limitation, with reference to the appended drawings in which.

Throughout the figures, the same references denote the same elements.

DESCRIPTION OF THE PREFERRED EMBODIMENTS

Figure 1:
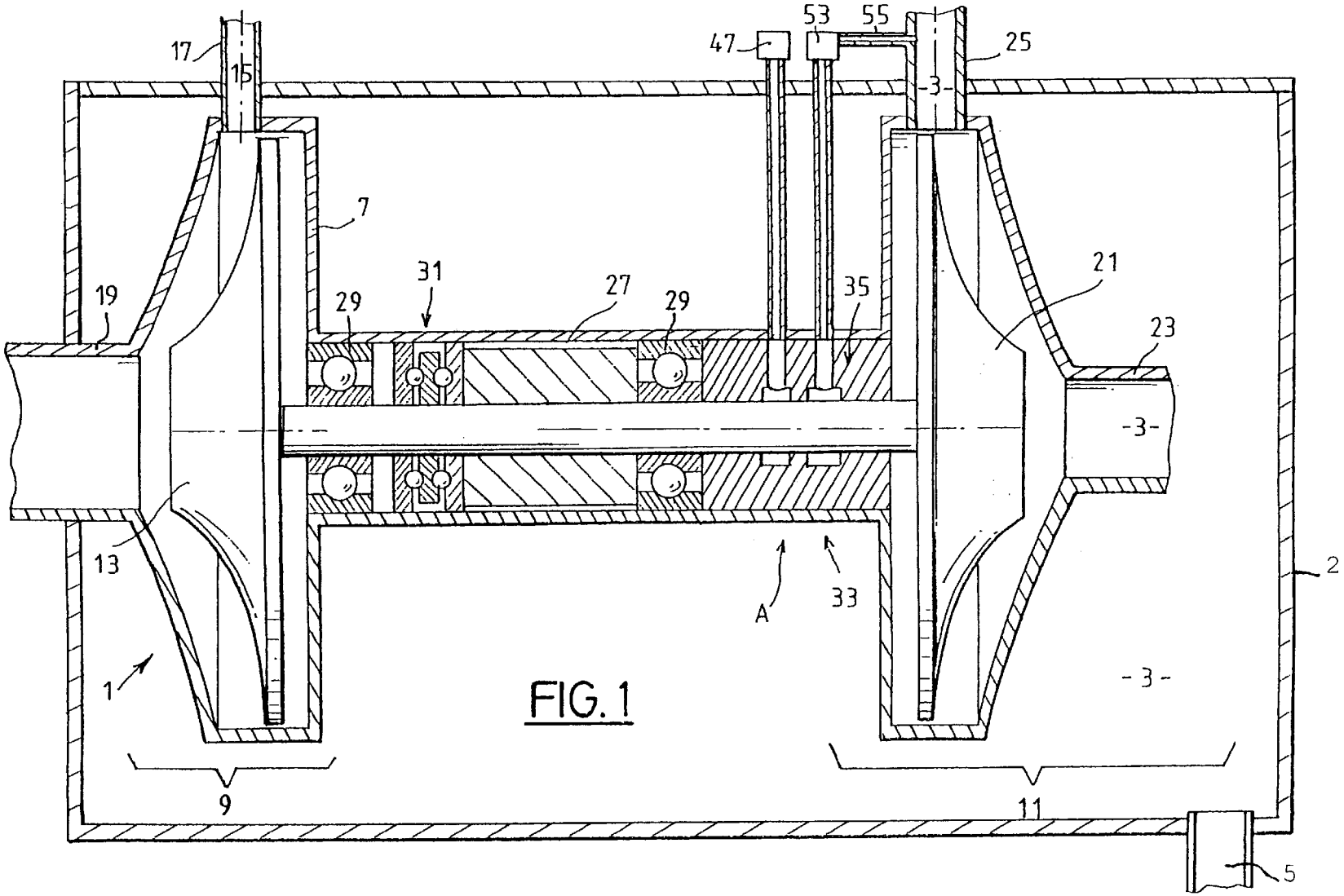
FIG. 1 is a schematic sectional view of a pump according to the invention immersed in a cryogenic liquid.

FIG. 1 represents a pump 1 according to the invention. This pump 1 is immersed in a cryogenic liquid 3 to be pumped, such as for example liquid oxygen contained in a thermally insulated compartment 2.

The compartment 2 may, for example, be a thermally insulated container which is arranged outside an air-distillation column and has an inlet 5 for the cryogenic liquid 3 to be pumped (as is represented in FIG. 1), or alternatively this compartment may be one of the bases of such a column. In the latter case, the pump will be arranged at the bottom of the base so as to be completely immersed in the cryogenic liquid to be pumped.

The pump 1 has a casing 7 in which a hydraulic motor 9 and a pumping component 11, driven by this hydraulic motor 9, are arranged side by side.

The hydraulic motor 9 comprises a driving wheel 13 driven by a motor liquid 15 under pressure which is supplied by means of a radial feed duct 17 and is subsequently discharged by means of an outlet duct 19. Each of the ducts 17 and 19 is connected to the casing 7 at suitable locations and passes through the compartment 2.

The motor liquid 15 under pressure is, for example, high-pressure liquid air or a rich liquid from an air-distillation column, that is to say oxygen-enriched liquid air or a lean liquid from such a column, that is to say almost pure liquid nitrogen. This motor liquid 15 preferably has a density in excess of 400 $kg/m^3$ and is supercooled before reaching the pump 1.

As can be seen in FIG. 1, the pump component 11 comprises a wheel 21 for pumping the cryogenic liquid 3 to be pumped and is driven by the hydraulic motor 9. When rotating, the pumping wheel 21 takes in the cryogenic liquid 3 through a central intake duct 23 and delivers it through a radial delivery duct 25.

In order to be driven, the pumping wheel 21 is mounted on a shaft 27 common with the driving wheel 13. This shaft 27 is supported by two axial bearings 29 as well as one radial bearing 31, which are arranged between the driving wheel 13 and the pumping wheel 21.

These bearings 29 and 31 are advantageously lubricated by means of the motor liquid 15.

In order to prevent the cryogenic liquid 3 to be pumped from being contaminated by the motor liquid 15, relative sealing means 33 are arranged between the driving wheel 13 and the pumping wheel 21, more specifically between an axial bearing 29 and the pumping wheel 21 in order to allow the bearing 29 to be lubricated by the motor liquid 15.

The relative sealing means 33 advantageously comprise a labyrinth seal 35 arranged around the common shaft 27.

Figure 2:
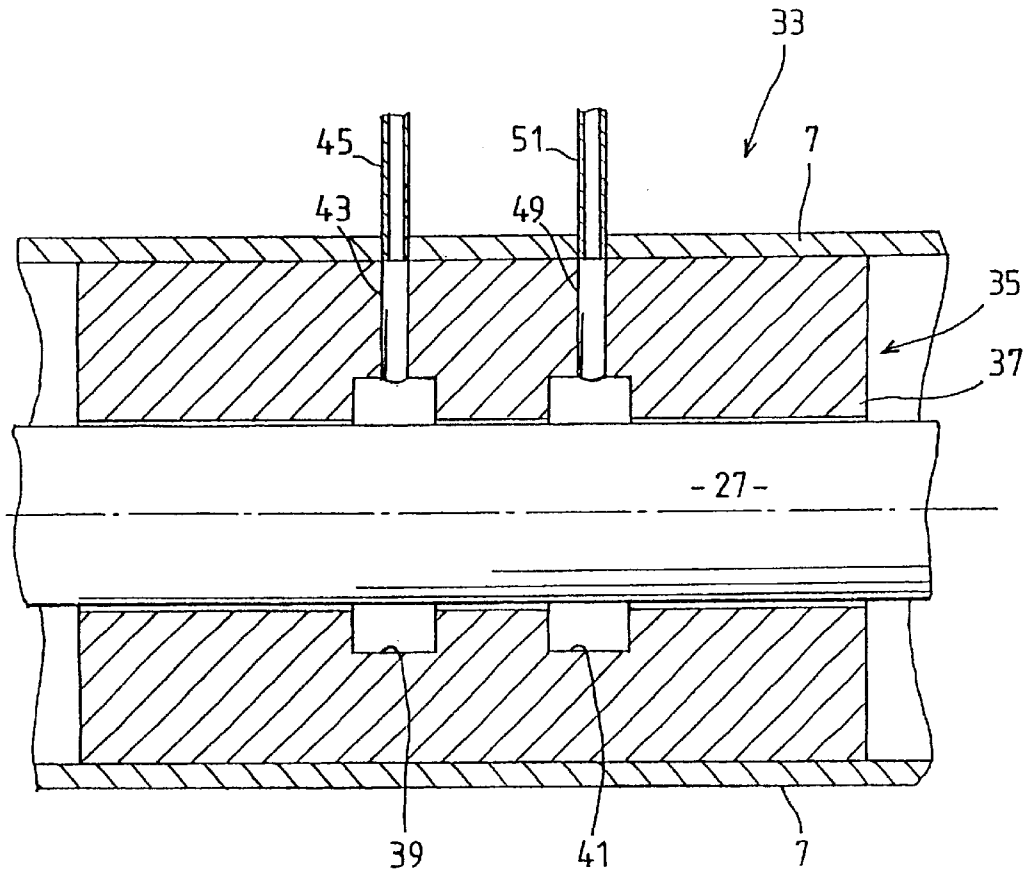
FIG. 2 is a sectional view of a detail A of FIG. 1.

Referring to FIG. 2, which shows the labyrinth seal 35 in more detail, it comprises a metal block 37 which is in leaktight contact with the internal wall of the casing 7 of the pump and through which the shaft 27 passes. Two annular cavities 39 and 41, which surround the shaft 27 and are separated from one another by a certain distance, are formed in this block 37.

The cavity 39 is connected by a duct 43, which is formed in the block 37 and is extended by a pipe 45 passing through the casing 7, to a first external vacuum source 47 (see FIG. 1) for taking in the motor liquid 15 and the cryogenic liquid 3 which have reached the cavity 39 via the gap resulting from the play between the block 37 and the shaft 27.

The cavity 41 is connected by a duct 49, which is formed in the block 37 and is extended by a pipe 51 passing through the casing 7, to a second external vacuum source 53 (see FIG. 1) in order to take in the cryogenic liquid 3 which has reached the cavity 41 via the gap between the block 37 and the shaft 27, and in order to deliver the liquid thus taken in to the duct 25 by means of a duct 55 in order to recover a fraction of the cryogenic liquid 3 which has leaked into the gap resulting from the play between the block 37 and the shaft 27.

The vacuum created by the source 47 is stronger than that of the source 53, so that the motor liquid 15 cannot leak to the cavity 41. Contamination of the cryogenic liquid 3 is thus effectively prevented.

The pump 1 according to the invention operates in the following way.

The motor liquid 15 is supplied under pressure and supercooled to the driving wheel 13 in order to drive the latter in rotation.

By means of the shaft 27, the driven driving wheel 13 itself drives the pumping wheel 21, thus causing the cryogenic liquid 3 to be pumped to be taken in via the central duct 23 into the pump and for it to be delivered by the duct 25.

Given that the bearings 29 and 31 are lubricated with the motor liquid 15, there is no need for an extra lubricant and the pump 1 is substantially simplified in terms of its construction. In particular, problems involving contamination of the pumped flow by an extra lubricant, which are customarily encountered in the field of pumps, are avoided.

Furthermore, the labyrinth seal 35 constitutes an effective way of, on the one hand, recovering a fraction of the leak of the cryogenic liquid 3 and, on the other hand, preventing its contamination by the motor liquid 15.

As a variant to the pump described with reference to FIGS. 1 and 2, a plurality of pumping wheels and/or driving wheels may be provided, which makes it possible, with equivalent flow rate, to reduce the speed of rotation of the shaft and thus the wear on the pump. This situation is referred to as that of a "multistage" pump.

Figure 3:
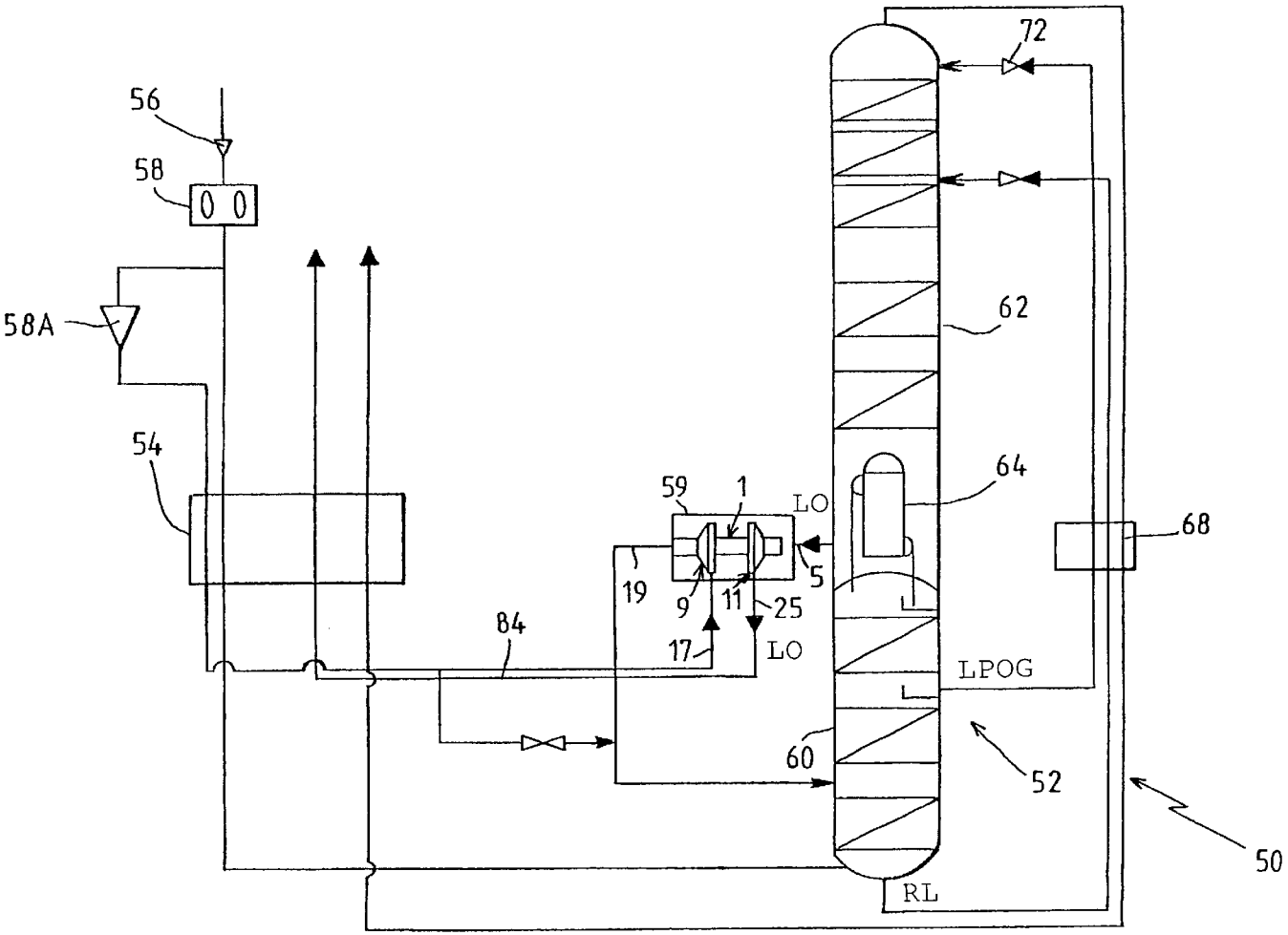
FIG. 3 is a schematic view of an air-distillation plant.

Advantageously, the pump 1 according to the invention is used in an air-distillation plant, such as for example the one which is schematically represented in FIG. 3 and has the reference number 50.

This plant 50 essentially comprises a double column 52, a main heat-exchange line 54, a compressor 56 of the air to be distilled and equipment 58 for purifying the air to be distilled. It is furthermore equipped with a compartment 59 containing a pump 1 according to the invention (schematically represented by its casing) for pumping the liquid oxygen produced during distillation to the main heat-exchange line 54.

The double column 52 comprises a medium-pressure column 60, operating at a medium pressure of, for example, 6 bar absolute, a low-pressure column 62, operating at a low pressure lower than the medium pressure, for example a pressure slightly higher than 1 bar absolute, and a main vaporizer/condenser 64.

The air gas to be distilled, compressed by the compressor 56 and purified with respect to water and with respect to $CO_2$, for example by adsorption, in the equipment 58, is cooled in the main heat-exchange line 54 and is injected at the base of the medium-pressure column 60 close to its dew point.

A fraction of the air at the output of the equipment 58 is compressed at high pressure in a compressor 58A, liquefied in the main heat-exchange line 54, then sent to the compartment 59 containing the pump 1 according to the invention.

In this compartment 59, the supercooled liquid air is used as a motor liquid 15 to drive the driving wheel 13 of the hydraulic motor 9. Due to the work done by the supercooled liquid air to drive the driving wheel 13, this liquid is relaxed and then sent to an intermediate level of the medium-pressure column 60.

The vaporizer/condenser 64 vaporizes liquid oxygen at the base of the low-pressure column 62 by condensing nitrogen from the head of the medium-pressure column 60.

Liquid oxygen LO drawn off from the base of the low-pressure column 62 is pumped by the pump 1 according to the invention, then sent via a pipe 84 to the main heat-exchange line 54, where this liquid oxygen is vaporized while the high-pressure air liquefies.

"Rich liquid" (oxygen-enriched air) RL is drawn off from the base of the medium-pressure column 60, then supercooled in a heat exchanger 68 and injected into the low-pressure column 62.

"Lean liquid" (almost pure liquid nitrogen) is taken from the upper part of the medium-pressure column 60, relaxed in a pressure-reducing valve 72, then injected to the top of the low-pressure column 62.

These lean and rich liquids can also be used as motor liquids for driving a pump according to the invention. In this case, the hydraulic motor will be connected into the transfer pipe instead of the valve 72 or 70.

It can therefore be seen that the pump according to the invention makes it possible, on the one hand, to relax the liquid transferred from the main heat-exchange line 54 to the medium-pressure column 60 before its injection into the latter, the work done during the relaxation being used to drive the pump and to draw off liquid oxygen from the base of the low-pressure column 62.

Figure 4:
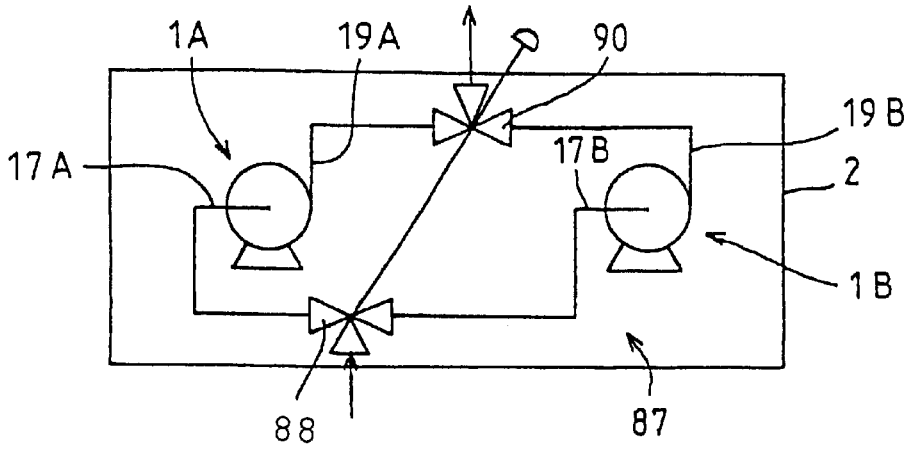
FIG. 4 is a diagram of a pumping unit according to the invention.

As schematically represented in FIG. 4, provision is made to arrange, in a compartment, a pumping unit 87 comprising two pumps 1A and 1B which are immersed in the cryogenic liquid 3 to be pumped and are connected in parallel in a duct carrying the motor liquid 15 under pressure in order to compensate for a possible wear-induced defect of one of the two pumps, which allows the maintenance intervals requiring shutdown of the distillation plant to be extended substantially.

In the ducts 17A and 17B for supplying the motor liquid to the pumps 1A and 1B, as well as in the ducts 19A and 19B for outlet of the motor liquid, a three-way valve 88, 90 is respectively arranged to allow switching between supply of the motor liquid 15 to one 1A or the other 1B of the two pumps.

Figure 5:
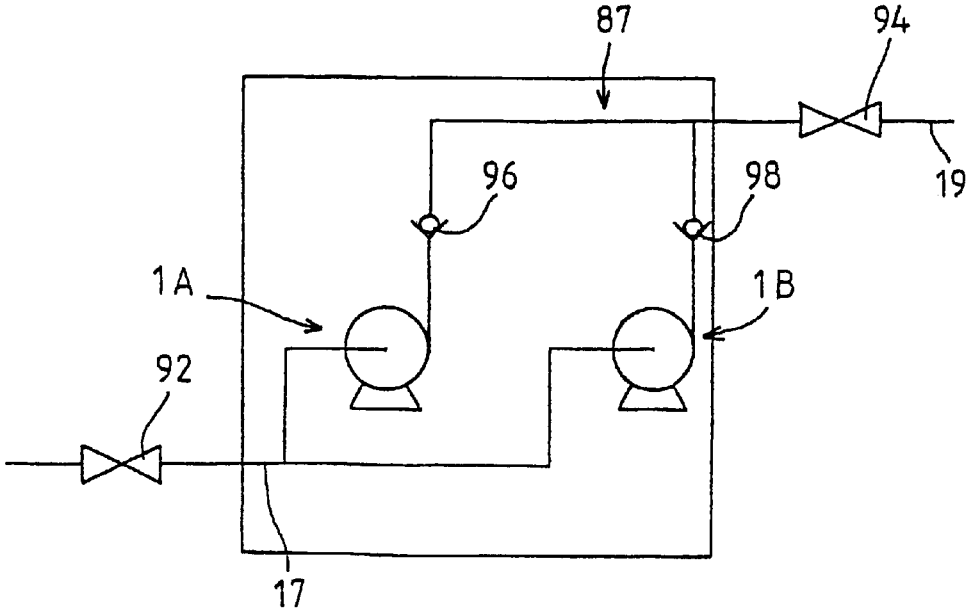
FIG. 5 is a variant of the pumping unit in FIG. 4.

Referring to FIG. 5, which schematically shows a simplified variant of the embodiment of the pumping unit 87 in FIG. 4, it can be seen that two control valves 92 and 94 are respectively arranged in a common feed duct 17 and in a common outlet duct 19 for the motor liquid 15, a non-return valve 96, 98 being arranged at the outlet of each pump 1A, 1B.

Figure 6:
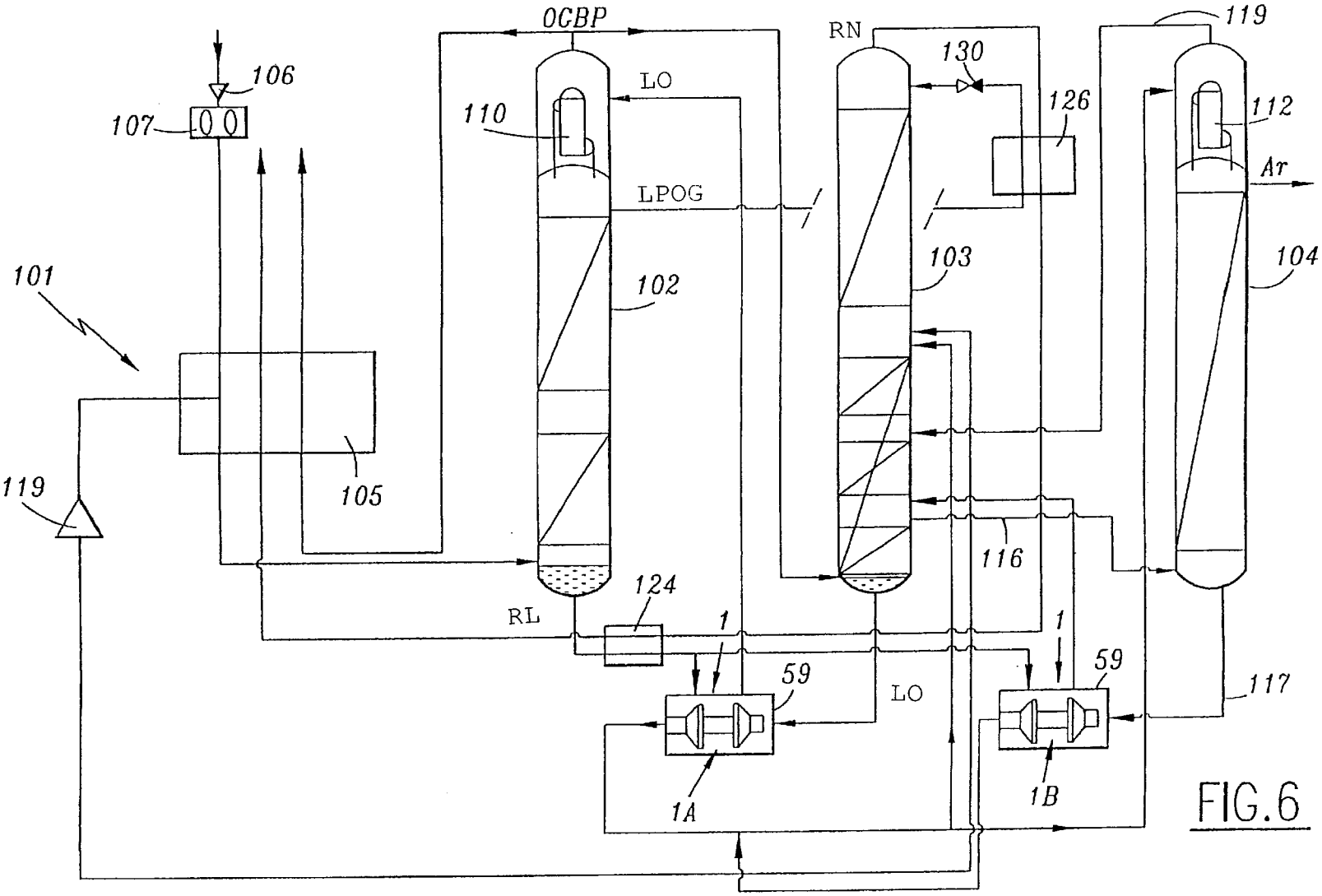
FIG. 6 is a schematic view of a variant of a distillation plant according to the invention.

FIG. 6 illustrates an air-distillation plant 101 with production of impure argon. This plant 101 essentially comprises a medium-pressure column 102 operating at a medium pressure of, for example, 6 bar absolute, a low-pressure column 103 operating at a pressure below the average pressure, for example a pressure slightly higher than 1 bar absolute, and an impure-argon production column 104, a main heat-exchange line 105, a compressor 106 of the air to be distilled and equipment 107 for purifying the air to be distilled.

The medium-pressure 102, low-pressure 103 and argon 104 columns are arranged side by side.

Furthermore, the medium-pressure column 102 comprises a main vaporizer/condenser 110, and the impure-argon production column 104 a head condenser 112.

A gas pipe 116, referred to as the argon tap, connects an intermediate point along the low-pressure column 103 to the base of the argon column 104, from the bottom of which a liquid return pipe 117 is pumped by a pump 1 according to the invention (represented schematically) and arranged in a housing 59 to the low-pressure column 103, and rejoins it at about the same level as the pipe 116.

A liquid pipe 119 joins the head of the column 104 to an intermediate level along the low-pressure column 103.

The air gas to be distilled, compressed by the compressor 106 and purified with respect to water and with respect to $CO_2$, for example by adsorption, in the equipment 107, is cooled in the main heat-exchange line 105 then divided in this line 105 into two flows. The first flow is injected to the base of the medium-pressure column 102 close to its dew point. The second flow is relaxed, for example in a turbine 119, and sent at an intermediate level into the low-pressure column 103, above the pipe 116.

"Rich liquid" (oxygen-enriched air) RL is drawn off from the base of the medium-pressure column 102, then supercooled in a heat exchanger 124 in order to be used as motor liquid for two pumps 1A and 1B according to the invention which are arranged in compartments 59 and are connected in parallel to the pipe for the rich liquid RL. The first pump 1A is used to pump liquid oxygen LO drawn off from the low-pressure base 103 to the main vaporizer/condenser 110, and the second pump 1B is used, as described above, to pump the liquid drawn off from the bottom of the base of the argon column 104 to the low-pressure column 103. Downstream of the two pumps 1A and 1B, the rich liquid RL is divided into two flows, one of which is sent to the head condenser 112 of the argon column 104, and the other to an intermediate level along the low-pressure column 103.

"Lean liquid" (almost pure nitrogen) LL is taken from the upper part of the medium-pressure column 102, then supercooled in a heat exchanger 126, subsequently relaxed in a pressure-reducing valve 130 and lastly injected to the top of the low-pressure column 103.

Impure or residual nitrogen RN drawn off from the top of the low-pressure column 103 is warmed on passing through the heat exchanger 126, then the heat-exchange line 5.

Low-pressure oxygen gas LPOG is drawn off from the head of the medium-pressure column and divided into two flows, one of which is injected to the base of the low-pressure column 103 and the other of which is warmed on passing through the main heat-exchange line 105.

As can be seen in the light of the examples above, the pump according to the invention allows advantageous use to be made of the energy resources available in an air-distillation plant, and does not require an electric current for its operation, so that the danger of the occurrence, for example of metal fires is effectively prevented. By virtue of its design, it is robust and reliable.

What is claimed is:

1. Pump (1) for a cyrogenic liquid (3) comprising:

a hydraulic motor (9) with a motor inlet for receipt of a motor liquid (15) under pressure and a driving wheel (13) driven by the motor liquid (15) and mounted on a shaft (27);

a pumping wheel (21) mounted commonly with the hydraulic motor on the shaft for pumping the cryogenic liquid (3);

a relative sealing means (33) preventing contamination of the cryogenic liquid (3) by transfer of the motor liquid (15) from the hydraulic motor to the pumping wheel, the relative sealing means (33) including a labyrinth seal (35) arranged around the shaft (27) between the driving wheel (13) and the pumping wheel (21); and a thermally insulated compartment (2) containing means for transporting the cryogenic liquid (3) to and from the pump compartment and containing the hydraulic motor, the pumping wheel, and the relative sealing means, wherein the motor liquid (15) has a density in excess of 400 kg/$M^3$.

2. Pump according to claim 1, wherein the motor liquid (15) under pressure is supercooled.

3. Pump according to claim 1, wherein the common shaft (27) is supported by bearings (29, 31) lubricated by the motor liquid (15).

4. Pump according to claim 1, wherein the relative sealing means transfers cryogenic liquid from the pumping wheel to the motor.

5. A unit for pumping a cryogenic liquid, comprising:

a first pump (1A) and a second pump (1B) arranged in parallel in a duct and carrying a motor liquid under pressure, each of the first and second pumps for pumping a cryogenic liquid (3) and including a hydraulic motor (9) with a motor inlet for receipt of the motor liquid (15) under pressure and a driving wheel (13) driven by the motor liquid (15) and mounted on a shaft (27), a pumping wheel (21) mounted commonly with the hydraulic motor on the shaft for pumping the cryogenic liquid (3), and a relative sealing means (33) preventing contamination of the cryogenic liquid (3) by transfer of the motor liquid (15) from the hydraulic motor to the pumping wheel, the relative sealing means (33) including a labyrinth seal (35) arranged around the shaft (27) between the driving wheel (13) and the pumping wheel (21); and a thermally insulated compartment (2) containing the first and second pumps and means for transporting the cryogenic liquid (3) to and from the first and second pumps, wherein there is arranged in the duct carrying the motor liquid a means (88, 90) for switching between a supply of the motor liquid to one (1A) or the other (1B) of the first and second pumps.

6. Plant (50; 101) for distillation of a gas comprising:

at least a first (60; 102) and a second (62; 103) column, the first column (60; 101) being pressurized at a first pressure higher than a second pressure prevailing in the second column (62; 103);

at least one pump (1) comprising a hydraulic motor (9) with a motor inlet and a driving wheel, the motor inlet receiving a pressurized motor liquid (15) with a density in excess of 400 kg/$M^3$, the driving wheel (13) driven by the motor liquid (15) and mounted on a shaft (27), a pumping wheel (21) mounted commonly with the hydraulic motor on the shaft for pumping the cryogenic liquid (3), and a relative sealing means (33) preventing contamination of the cryogenic liquid (3) by transfer of the motor liquid (15) from the hydraulic motor to the pumping wheel, the relative sealing means (33) including a labyrinth seal (35) arranged around the shaft (27) between the driving wheel (13) and the pumping wheel (21);

a thermally insulated compartment (2) containing the at least one pump and means for transporting the cryogenic liquid to and from the at least one pump, wherein the at least one pump pumps a cryogenic liquid delivered by one of the said first and second columns (60, 62; 102, 103), the at least one pump (1) being driven by the motor liquid delivered by the plant (50; 101).

7. Distillation plant according to claim 6, wherein the motor liquid is an oxygen-rich liquid.

8. Distillation plant according to claim 6, wherein the motor liquid is a low-oxygen liquid.

9. Plant for distillation of a gas comprising:

at least a first and a second column, the first column being pressurized at a first pressure higher than a second pressure prevailing in the second column;

at least one pump (1) comprising a hydraulic motor (9) with a motor inlet and a driving wheel, the motor inlet receiving a pressurized motor liquid (15), the driving wheel (13) driven by the motor liquid (15) and mounted on a shaft (27), a pumping wheel (21) mounted commonly with the hydraulic motor on the shaft for pumping the cryogenic liquid (3), and a relative sealing means (33) preventing contamination of the cryogenic liquid (3) by transfer of the motor liquid (15) from the hydraulic motor to the pumping wheel, the relative sealing means (33) including a labyrinth seal (35) arranged around the shaft (27) between the driving wheel (13) and the pumping wheel (21);

a thermally insulated compartment (2) containing the at least one pump and means for transporting the cryogenic liquid to and from the at least one pump, wherein the at least one pump pumps a cryogenic liquid delivered by one of the said first and second columns, the at least one pump (1) being driven by the motor liquid delivered by the slant (50; 101), and the said motor liquid is liquid air delivered by a heat-exchange line (54).

10. Distillation plant according to claim 9, wherein the first and second columns comprise a double column (52), including a medium-pressure column (60) and a low-pressure column (62).

11. Distillation plant according to claim 9, wherein the first and second columns are arranged side by side.

12. Distillation plant according to claim 11, wherein the cryogenic liquid which is pumped in an oxygen-rich liquid.

13. Distillation plant according to claim 9, further comprising and impure-argon column, wherein the cryogenic liquid which is pumped is a liquid from the impure-argon production column (104).

14. Distillation plant according to claim 9, further comprising a low-pressure column; and a vaporizer, wherein the cryogenic liquid which is pumped is a liquid from the low-pressure column (103) and is sent to the vaporizer.

15. A pump for a cryogenic liquid, comprising:

a shaft;

a hydraulic motor with a motor liquid feed accepting a pressurized motor liquid and a driving wheel mounted of the shaft and driven by the motor liquid;

a pumping wheel mounted on the shaft and driven by the hydraulic motor, for pumping the cryogenic liquid;

a relative sealing means, associated with the wheel, for preventing contamination of the cryogenic liquid by transfer of the motor liquid from the hydraulic motor to the pumping wheel, the relative sealing means including a labyrinth seal arranged around the shaft between the driving wheel and the pumping wheel, wherein the relative sealing means transfers the cryogenic liquid from the pumping wheel to the motor.

16. Pump according to claim 15, further comprising a container filled with the cryogenic liquid to be pumped and immersing the motor, pumping wheel, and sealing means.

17. Pump according to claim 15, wherein the motor liquid is supercooled.

18. Pump according to claim 15, wherein the motor liquid has a density in excess of 400 $kg/M^3$.

19. Pump according to claim 15, wherein the shaft comprises bearings lubricated by the motor liquid.

* * * * *